United States Patent [19]

Hodgson

[11] Patent Number: 4,708,006

[45] Date of Patent: Nov. 24, 1987

[54] COMBINATION LOCKS

[75] Inventor: Earl I. Hodgson, Ottawa, Canada

[73] Assignee: Canadian Patents and Development Limited, Ottawa, Canada

[21] Appl. No.: 661,040

[22] Filed: Oct. 15, 1984

Related U.S. Application Data

[63] Continuation-in-part of Ser. No. 421,844, Sep. 23, 1982, abandoned.

[30] Foreign Application Priority Data

Jun. 4, 1982 [CA] Canada ..... 404842

[51] Int. Cl.[4] ..... E05B 37/04

[52] U.S. Cl. ..... 70/303 R; 70/311; 70/323

[58] Field of Search ..... 70/302, 303 A, 303 R, 70/308, 309, 311, 318, 323

[56] References Cited

U.S. PATENT DOCUMENTS

| | | | |
|---|---|---|---|
| 475,520 | 5/1892 | Roche | 70/303 R |
| 747,116 | 12/1903 | Amstalden | 70/303 R |
| 1,655,002 | 1/1928 | Winning et al. | 70/303 A |
| 2,129,228 | 9/1938 | Miller | 70/302 |
| 2,766,606 | 10/1956 | Whitehead | 70/303 A |
| 2,775,115 | 12/1956 | Bremer | 70/303 A |
| 3,628,355 | 12/1971 | Zangrando | 70/303 R |
| 4,104,896 | 8/1978 | Hahn | 70/311 X |
| 4,127,995 | 12/1978 | Miller | 70/303 R |
| 4,163,376 | 8/1979 | Miller et al. | 70/323 X |
| 4,358,942 | 11/1982 | Mattson | 70/311 |

FOREIGN PATENT DOCUMENTS

| | | | |
|---|---|---|---|
| 157285 | 12/1952 | Australia | 70/32 |
| 1251177 | 9/1967 | Fed. Rep. of Germany | 70/303 A |
| 25086 | of 1907 | United Kingdom | 70/302 |

*Primary Examiner*—Robert L. Wolfe
*Assistant Examiner*—Suzanne L. Dino
*Attorney, Agent, or Firm*—Robert G. Hendry

[57] ABSTRACT

A combination lock having two or more disks and a cam which includes a drive pin for driving an adjacent disk which, in turn, drives the next disk. The disks have pins adapted to be received in apertures in two or more disks, known as wheel gates, the disks and the cam can be moved inwardly. In this position, a notch on the cam engages a nose on a drop lever which is in turn connected to the locking bolt. Rotation of the cam in one direction will then move the bolt to the unlocked position.

3 Claims, 5 Drawing Figures

COMBINATION LOCKS

This is a continuation-in-part application of U.S. application Ser. No.: 421,844 filed Sept. 23, 1982 now abandoned.

This invention relates to combination locks and more particularly, to a combination lock which has greater resistance to surreptitious method of attack.

In general, known combination locks comprise a dial secured to a spindle and a wheel pack carried by the spindle, which is made up of disks having notches or gates. A fence is adapted to be received in the gates and a nose on a drop lever is adapted to engage a notch in a cam carried by the wheel pack. The other end of the drop lever is secured to a slidable bolt by a screw.

Combination locks of this type can be attacked in a number of ways, including attacking the spindle, drilling or using radiography to read wheel gates. Another method of attack is that of drilling out the screw connecting the bolt to the drop lever and manipulating the bolt.

It is an object of the present invention to provide a combination lock which will be resistant to attack on the spindle and the screw connecting the bolt to the drop lever.

A further object of the invention is the provision of a combination lock which cannot be read by known radiography methods.

A further object of the present invention is the provision of a wheel pack which does not have the conventional notches which give audible sounds as the wheel pack is turned, thus giving an indication of the location of such notches to an intruder using a listening device such as a stethoscope.

A still further object is the provision of a combination lock that is resistant to known methods of drilling holes through which the wheel pack positions can be read.

Accordingly, the present invention provides a combination lock comprising a housing, a dial secured to a spindle, a cam in said housing carried by said spindle, said cam having a notch in a side edge adjacent said dial and a drive pin in an opposing face thereof, a wheel pack including a plurality of disks mounted for rotation in said housing. A first one of said disks having means on a second disk, said second disk also having a drive pin for engagement with means on a third disk, each of said disks having pins adapted to be received in apertures in first, second and third wheel gates, respectively, and a drop lever having a nose at one end adapted to be received in said notch in said cam and having its other end secured to a locking bolt slideably mounted in said housing, whereby if the correct combination is dialed, said pins on said wheel pack are in alignment with said apertures in said wheel gates, so as to be received therein so that the cam and spindle move into the housing causing said notch on said cam to receive said nose on said lever, and rotation of the spindle and cam pulls said lever and said bolt inwardly to the unlocked position.

Figures 1, 2:
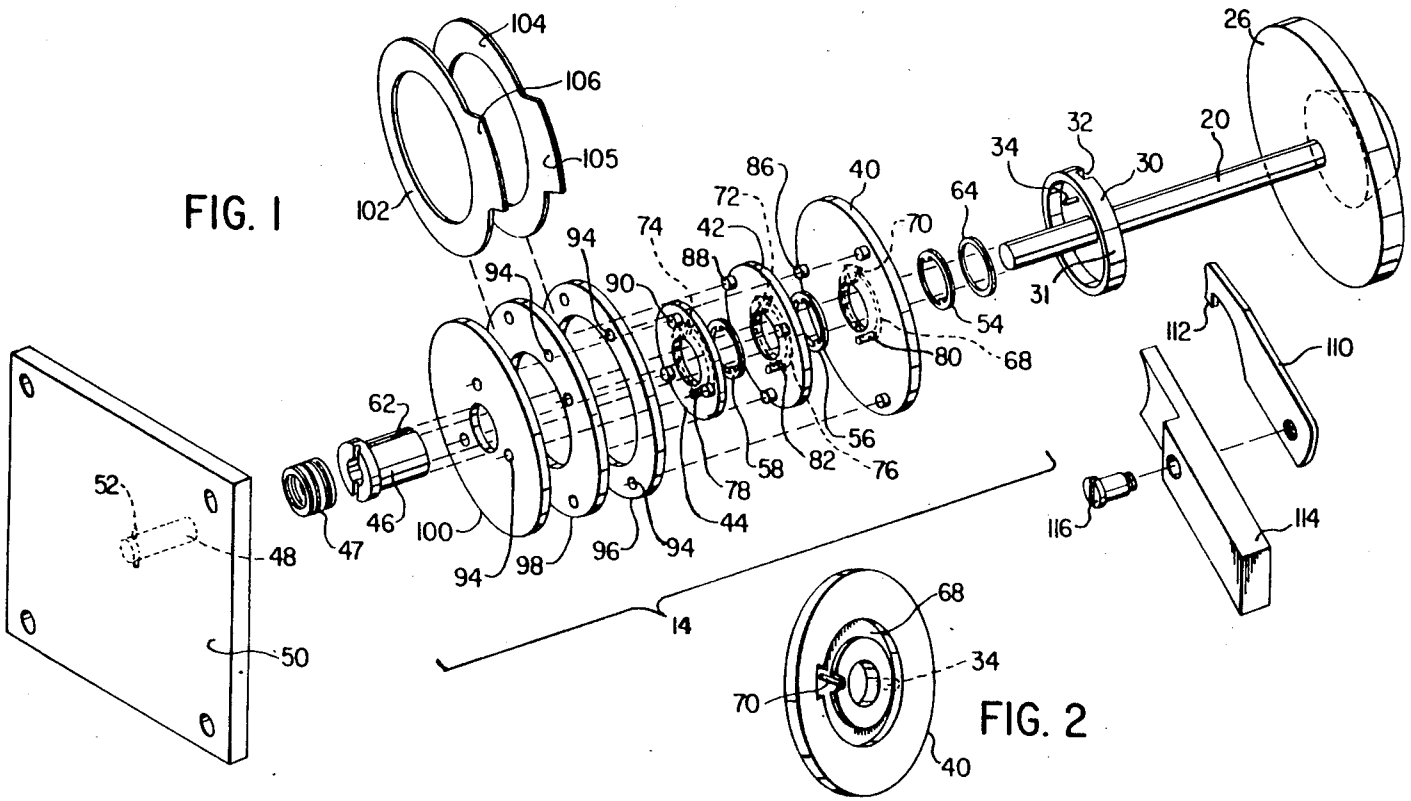
FIG. 1 is an exploded perspective view of the combination lock mechanism of this invention.
FIG. 2 is a perspective view showing the reverse side of one of the wheel pack disks of FIG. 1.
Figure 3:
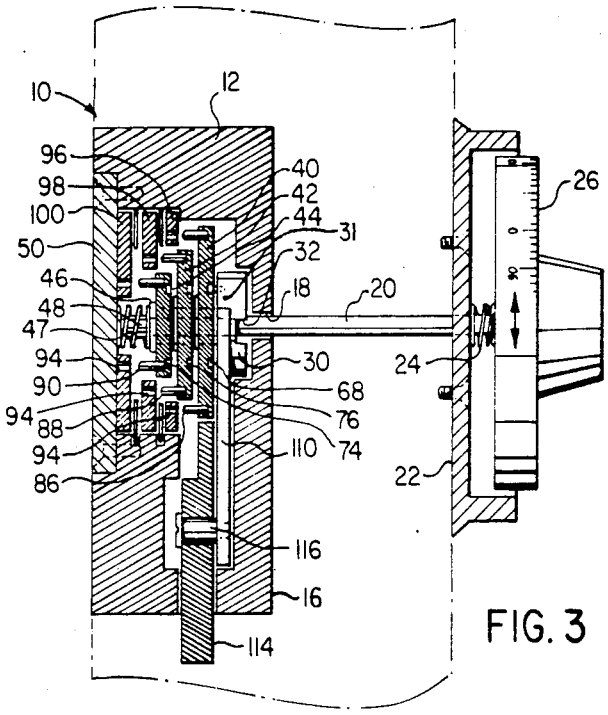
FIG. 3 is a part-section top view of the combination lock including the housing showing the locked position.

Referring now in detail to the drawings, a combination lock shown generally at 10, in FIG. 3, includes a housing 12 adapted to receive a lock assemby 14, shown in FIG. 1.

The front wall 16 of the housing 12 has a bore 18 to receive the spndle 20 of the lock 10. The spindle 20 extends through plate dial ring 22, compression spring 24 and has a dial 26 secured to its outer end.

A cam 30, in the housing 12, is secured to the spindle 20. The cam 30 has a smooth periphery 31 on one side and the nose 112 of the drop lever 110 follows the smooth continuous circular side of the periphery of the cam 30 as can be seen more clearly in FIG. 3. The smooth periphery of the cam unlike the known fence and tumbler systems causes no clicks to give away the location of notches in tumblers.

A wheel pack comprising three apertured disks 40, 42 and 44 is journalled for rotation on an idler bushing 46, and return spring 47, received on a stub shaft 48, on a rear cover plate 50 of the housing 12. Rotation of the bushing 46 is prevented by a pin 52. Anti-rotation washers 54, 56 and 58, are positioned between the cam 30, the disk 40, the disk 42 and the disk 40, and between the disk 42 and the disk 44. Projections on the washers 54, 56 and 58 engage grooves 62 (only one of which is shown) on the idler bushing 46. A locking ring 64 retains the wheel pack on the bushing 46.

The drive pin 34 is received in an annular groove 68 in the disk 40 (shown more clearly in FIG. 2) which includes an indentation adapted to receive means for engaging the drive pin 34, commonly known as a flop fly 70. This flop fly 70 is a pin having a right angle bend, one end of the pin is received in an aperture in the disk. The flop fly 70 is designed to move through an arc of approximately 90° in the indentation, thus allowing the drive pin 34 to move through the full 360° in both directions.

Similarly, flop flies 72 and 74 and annular grooves 76 and 78 are also provided on disks 42 and 44, for engaging drive pins 80 and 82.

It will be noted that the relative diameter of each of the disks, 40, 42 and 44, is such that three pins 86 on the disk 40 will extend past the periphery of the disk 42. Similarly, pins 88 on the disk 42 extend past the disk 44. Pins 90 are also provided on the disk 44.

The pins 86, 88 and 90, when aligned, will be received in apertures 94 in disks 96, 98 and 100 having a pair of anti-rotational rings 102 and 104 therebetween, and are retained in the housing 12 by the plate 50, which acts as a pressure pad to prevent rotation when a selected orientation has been given to disks 96, 98 and 100, thus providing the combination. Tab or projection 105, 106, on the anti-rotation rings 102 and 104 engage grooves 108 and 200 in an inner wall of the housing 12.

A drop lever 110, having a nose 112 adapted to engage the notch 32 of the cam 30, has its other end secured to a locking bolt 114 as by a screw 116.

Figure 5:
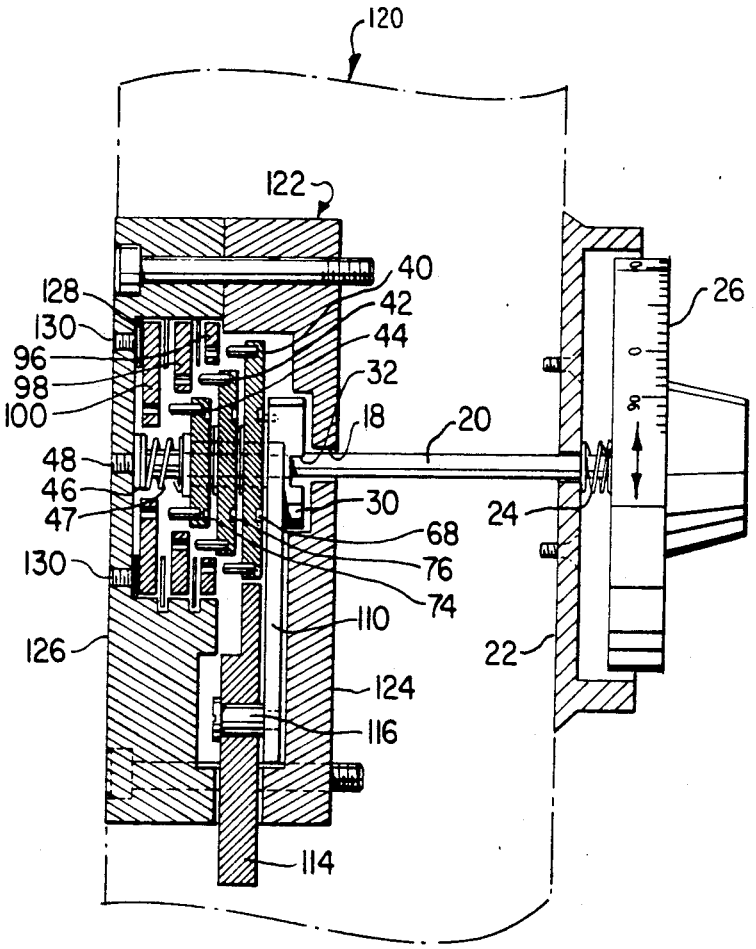
FIG. 5 is an alternative construction of the lock of FIG. 4.

Alternatively, the lock 10 may be constructed as shown at 120 in FIG. 5. The lock 120 has a housing 122 comprising front and back portions 124, 126, thus eliminating the rear cover plate 50 of the lock 10. An apertured disk 128, similar to disks 102 and 104 is positioned in the housing between the wheel gate 100 and the back wall of the housing portion 126. Set screws 130, extending through threaded apertures in the back wall of the housing are adapted to engage the apertured disk 128 and move it inwardly to apply pressure on the wheel gate 100 in much the same manner as the cover plate 50 of the lock 10.

All other elements of the lock 120 are the same as the lock 10 with the exception that the idler bushing 46 is turned end for end and the stub shaft 48 is threadedly mounted on the inner face of the back portion 126 of the housing 122.

Figure 4:
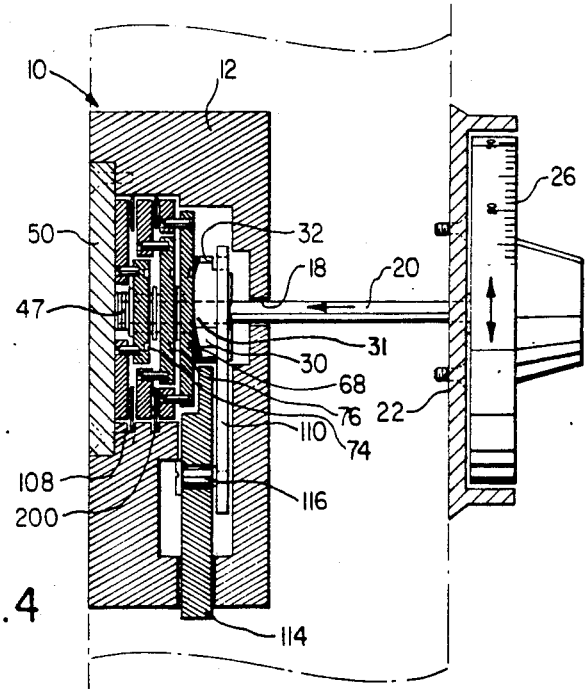
FIG. 4 is a part-sectional top view of the lock assembly and housing showing the unlocked positions.

In operation, the dial 26 is rotated clockwise and counterclockwise to dial the combination, thereby aligning the pins 86, 88 and 90 with the apertures 94 of the wheel gates 96, 98 and 100. The dial 26, the spindle 20, and the cam 30, are then pushed inwardly as shown in FIG. 4. The wheel pack disks 40, 42 and 44 also move inwardly. This inward movement brings the notch 32, on the cam 30 into lateral alignment with the nose 112 of the drop lever and proper rotation of the dial causes the nose 112 to drop into the notch 32 so that clockwise rotation of the cam 30 will draw the bolt 114 inwardly to the unlocked position. It should be noted that until the wheel pack moves inwardly, there is insufficient space for the bolt to move inwardly. It is, therefore not possible to manipulate the bolt 114, with wire or the like, to an unlocked position.

When a change in the combination is required, it is first necessary to dial the old combination and place a pin (not shown) through a hole in the drop lever so to hold it in the up position. The screws holding the pressure pad 50 are then loosened thereby releasing the pressure on the wheel gates 96, 98, 100. The dial is then pushed in and held in while dialing the new combination. After dialing the new combination, the screws on the pressure pad 50 are tightened and the pin holding the drop lever 110 is removed.

I claim:

1. A combination lock comprising a housing, a dial secured to a spindle, a cam in said housing carried by said spindle, said cam having a smooth periphery on one side and a notch in a side edge adjacent said dial, and a drive pin in an opposing face, a wheel pack including a plurality of disks aligned consecutively as a pack adjacent each other at one end of said spindle mounted for semi-independent rotation in said housing, a first one of said disks having means for engaging said drive pin on said cam, and a drive pin for engaging means on a second disk of lesser diameter than said first disk, said second disk also having a drive pin for engagement with means on a third disk of lesser diameter than said second disk, each of said disks having pins, a first, a second and a third rotatable wheel gate, having apertures for receiving said pins on said first, second and third disks respectively, and a drop lever having a nose at one end adapted to be received in said notch in said cam and having its other end secured to a locking bolt slideably mounted in said housing, whereby, if the correct combination is dialed, said pins on said wheel pack are in alignment with said apertures in said wheel gates so as to be received therein so that the cam and spindle move into the housing causing said notch on said cam to receive said nose on said lever and rotation of the spindle and cam pulls said lever and said locking bolt inwardly to the unlocked position.

2. A combination lock as claimed in claim 1 wherein said means on said disks for engaging said drive pins comprises an indentation in said disk, and a pin having a right angle bend; one end of said pin being received in an aperture in said disk; and an annular groove in each disk, whereby said drive pins moves around said annular groove to engage said pin in said indentation and cause limited arcuate movement thereof, before moving said disk.

3. A lock as claimed in claim 1 wherein said locking bolt is so dimensioned that it cannot move into said housing until said wheel pack is moved inwardly.

* * * * *